United States Patent [19]

Weaver et al.

[11] 4,353,515

[45] Oct. 12, 1982

[54] SPOOL MOUNTING ASSEMBLY AND BRAKE

[76] Inventors: David A. Weaver, N. Highway 59; Gordon G. Bledsoe, 601 Mill St., both of Mound City, Mo. 64470

[21] Appl. No.: 221,026

[22] Filed: Dec. 29, 1980

[51] Int. Cl.[3] ..... B65H 75/30; B65H 75/40

[52] U.S. Cl. ..... 242/86.7; 242/99; 242/156; 242/129.6

[58] Field of Search ..... 242/86.7, 99, 156, 156.2, 242/129.6, 129.62, 75.4, 75.43, 68.4

[56] References Cited

U.S. PATENT DOCUMENTS

| | | | |
|---|---|---|---|
| 246,402 | 8/1881 | McClure | 242/99 |
| 3,019,995 | 2/1962 | Eckert et al. | 242/156.2 X |
| 3,127,125 | 3/1964 | Jilbert | 242/75.4 |
| 3,197,153 | 7/1965 | Davidson | 242/156.2 X |
| 4,166,589 | 9/1979 | Hoover et al. | 242/75.4 |
| 4,190,211 | 2/1980 | Janzen | 242/86.7 |

FOREIGN PATENT DOCUMENTS

| | | | |
|---|---|---|---|
| 711140 | 6/1954 | United Kingdom | 242/156 |

*Primary Examiner*—John M. Jillions

*Attorney, Agent, or Firm*—Kokjer, Kircher, Bradley, Wharton, Bowman & Johnson

[57] ABSTRACT

A mechanism for mounting a spool on a shaft is the subject of the present invention. First and second bearing means are provided which are designed to fit over the shaft and be received within the openings of a large wooden spool. Each bearing has a frusto-conical annular surface so that it can accommodate different sized openings in the spool. A sleeve member abuts one of the bearings and is comprised of first and second sleeve components which are complementally threaded. Means is provided for rotating the two sleeve components relative to each other whereby the effective length of the sleeve may be increased or decreased. This provides means for providing a lateral force acting against one of the bearings which in turn controls the speed of rotation of the spool. When it is desired to stop rotation of the spool, the two sleeve components are turned relative to each other a sufficient distance so as to apply a lateral force against the spool a sufficient magnitude to stop all rotation.

3 Claims, 5 Drawing Figures

SPOOL MOUNTING ASSEMBLY AND BRAKE

This invention relates generally to apparatus for handling large spools and, more particularly, to a device for mounting a spool on a shaft and also serving as a brake for the spool.

Most types of commercial cable are carried by large wooden spools three to four feet in diameter. When a cable is to be strung on poles or buried in the ground, the spool is often mounted on a wheeled trailer and pulled to the site where it is to be installed. If the terrain permits, the trailer with the spool mounted on it will be pulled along the construction right of way and the cable unwound from the spool as required.

With the ever increasing popularity of cable television, coaxial cable for use in conjunction with television transmissions has become widely used. This type of cable is more fragile than solid wire cable of the type used for power lines, thus requiring greater care in handling and during placement.

Heretofore, large spools of television cable have been mounted on shafts and makeshift brakes have been employed to apply force to the spool to hold it in place when it was not desired to rotate the spool. Because the spool openings are somewhat larger than the shaft, the spool will often become cocked relative to the shaft and may bind or otherwise not rotate true on the shaft. This can cause damage to the cable. The spool may also be damaged by the loose fit between the shaft and the spool. The problem increases in magnitude over the life of the spool. Although the prior art devices have employed crude brakes, there has been no means for gradually slowing down rotation of the spool and easily and quickly applying a braking action.

It is, therefore, a primary object of the present invention to provide mechanism for holding spools of wire or cable on a shaft which will provide for ease in rotating the spool and also prevent binding of the spool because of misfit between the spool opening and the shaft.

Another object of the invention is to provide a mechanism for holding multiple spools in proper relationship to the longitudinal dimension of a mounting shaft so as to facilitate rotation of the spool relative to the shaft.

An important aim of our invention is to provide a device for holding one or more spools on a shaft which is self-adjusting to accommodate various sized holes in the spools to be mounted.

A principle purpose of the invention is to provide a mechanism meeting the criteria of the foregoing aim and objects which also provides a braking function to prevent rotation of the spools when desired.

Another objective of the invention is to provide a device for controlling the speed of rotation of a spool on a shaft by applying varying degrees of force against the spool.

Other objects of the invention will be made clear or become apparent from the following description and claims when read in light of the accompanying drawing wherein:

Figure 1:
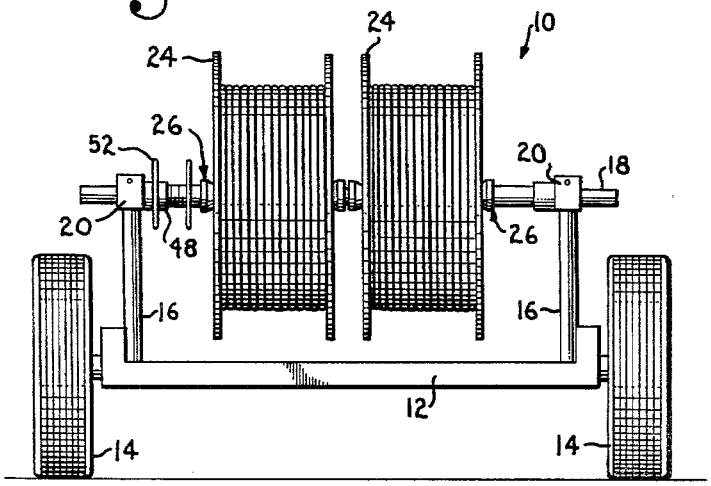
FIG. 1 is a front elevational view of the device according to the present invention mounted on a vehicle for transporting spools of cable.
Figure 2:
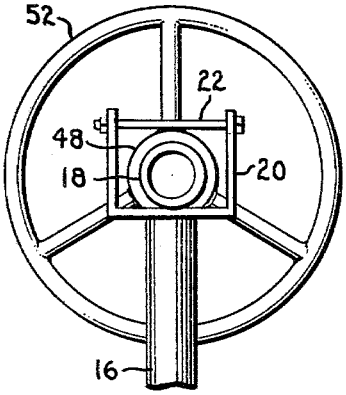
FIG. 2 is an enlarged end elevational view showing how the apparatus of the invention is mounted on the upright standards of the vehicle.

Referring initially to FIG. 1, a transport vehicle is designated generally by the numeral 10 and comprises a platform 12, wheels 14 and upright standards 16. A shaft 18 is mounted on standards 16 and is held in place by U-brackets 20 and a keeper assembly 22 disposed atop each of the standards. The aforedescribed assembly is commonly used to transport large spools of wire or cable and does not form any part of the present invention.

Two large spools 24 are mounted on shaft 18 by the mechanism of the present invention which is designated generally by the numeral 26.

Figure 3:
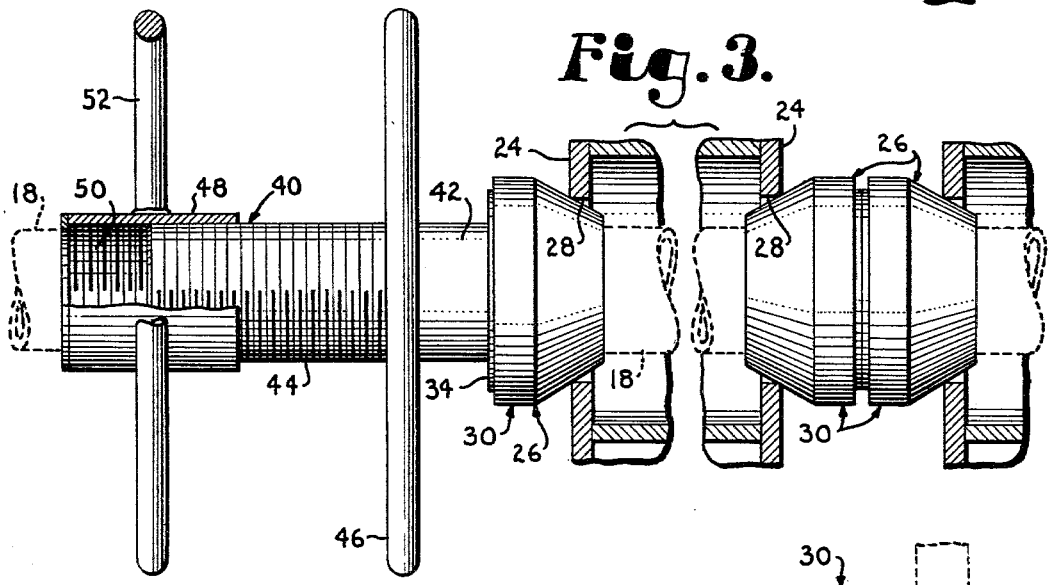
FIG. 3 is an enlarged detail elevational view of the mechanism according to the present invention.
Figure 4:
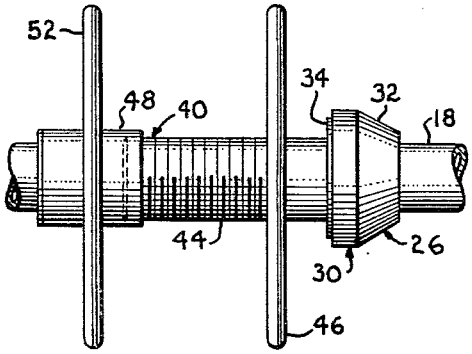
FIG. 4 is an enlarged fragmentary elevational view illustrating the manner of applying a braking action utilizing the device of the invention.

Referring to FIG. 3, each of spools 24 is normally made of wood and has an opening 28 in its side, which opening extends through the spool and is somewhat larger in diameter than the diameter of shaft 18.

Figure 5:
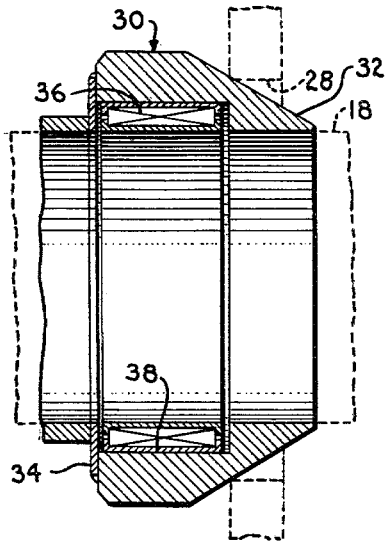
FIG. 5 is a vertical cross-sectional view through one of the bearing members of the device of the invention illustrating mounting of a cable spool by the bearing.

The mechanism of the present invention comprises first, second, third and fourth bearing members each of which is identical and each of which is designated by the numeral 30. Details of construction of bearing 30 are best understood with reference to FIG. 5. The bearing 30 has an internal opening diameter slightly greater than the outside diameter of shaft 18 so as to fit over the shaft. A frusto-conical annular surface 32 is adapted to be positioned at least partially within a spool opening 28. A wear plate 34 is disposed on the outside flat surface of the bearing and a plurality of roller bearings 36 are retained within an inner bearing race 38.

A two-component threaded sleeve is designed to slip over shaft 18 and abut one of the bearings 30 in the manner illustrated in FIG. 3. A first sleeve component 42 is provided with external threads 44 and a wheel type handle 46. This component mates with second component 48 having complemental internal threads and a wheel type handle 52.

In use, bearings 30 are inserted into spool openings 28 and the bearing and spool assembly mounted on shaft 18. By virtue of the fact that the largest diameter point on frusto-conical surface 32 is of a substantially larger dimension that the diameter of opening 28, and the smallest diameter point of the surface is somewhat smaller than the opening, different sized openings in spools 24 may be accommodated. Bearings 30 will be self-adjusting so as to properly mount the spools and hold them in place on the shaft. Next, sleeve 40 is slipped over the shaft and brought into abutting relationship with bearing 30. By virtue of the two-component complementally threaded sleeve, the effective length thereof may be adjusted so as to abut the adjacent bearing 30 without applying any lateral force against the bearing. Also, wheel 46 may be rotated while wheel 52 is held in place, thus changing the effective length of sleeve 40 so as to allow controlled rotation of spools 24. Manifestly, if it is desired to slow down the speed of rotation of the spools on the shaft, the effective length of sleeve 40 is increased by rotating wheel 46 so as to apply a slight lateral force against the adjacent bearing. When it is desired to completely stop rotation of the spools, wheel 40 is turned until the length of sleeve 40 is extended to apply sufficient lateral force to prevent rotation of the spools.

It is to be noted that the two centermost bearings 30 are in abutting relationship and sleeve component 42 abuts bearing 30 which is adjacent to it. In each case, the contact surface is wear plate 34 which may be replaced if necessary without replacing the entire bearing.

From the foregoing description, it is believed that out invention is clearly described and meets all of the aims and objectives heretofore set forth. In particular, a mechanism is provided for the first time which serves to mount a spool (or a plurality of spools) on a shaft and can accommodate spools having different sized openings. The mounting arrangement protects the spool and also prevents the spool from binding on the shaft by virtue of the bearing mount. This assures that the cable will unwind evenly without binding or kinking which often damages the cable. The mechanism also provides for precise control of the speed of rotation of the spools and a positive braking action when rotation is to be stopped.

We claim:

1. Mechanism for mounting a spool on a shaft, said spool having an opening through its center larger than the shaft diameter, said mechanism comprising:

first and second bearing means each having a frusto-conical annular surface adapted to be positioned at least partially within said spool opening, one of said bearing means being disposed on each side of said spool with said frusto-conical surfaces in facing relationship;

sleeve means adapted to be positioned over said shaft and in abutting relationship to one of said bearing means, said sleeve means comprising first and second threaded components and means for rotating said components relative to each other whereby relative rotation of said components in one direction will cause said first and second bearing means to grip said spool and hold the latter against rotation.

2. The invention of claim 1, wherein said means for rotating said components comprises wheel means mounted on at least one of said components.

3. The invention of claim 1, wherein said mechanism is adapted for mounting a pair of said spools on said shaft in side-by-side relationship, said mechanism including third and fourth bearing means each having a frusto-conical annular surface adapted to be positioned at least partially within the opening of one of said spools.

* * * * *